United States Patent [19]

Bohannon

[11] 4,256,417

[45] Mar. 17, 1981

[54] VARIABLE STIFFNESS LOWER JOINT FOR PIPE RISER WITH FIXED BOTTOM

[75] Inventor: John M. Bohannon, Houston, Tex.

[73] Assignee: Conoco, Inc., Ponca City, Okla.

[21] Appl. No.: 957,653

[22] Filed: Nov. 3, 1978

[51] Int. Cl.[3] ..... E02D 21/00

[52] U.S. Cl. ..... 405/195; 405/203

[58] Field of Search ..... 405/195, 211, 196–208; 166/367, 359, 355; 52/40, 80, 246, 249, 722, 723; 43/18 R, 18 GF

[56] References Cited

U.S. PATENT DOCUMENTS

| | | | |
|---|---|---|---|
| 512,504 | 1/1894 | Custodis | 52/249 X |
| 890,373 | 6/1908 | Orr | 52/40 X |
| 1,344,608 | 6/1920 | Alston | 52/246 X |
| 1,706,246 | 3/1929 | Miller | 405/229 |
| 2,204,955 | 6/1940 | Beeby | 52/249 X |
| 3,003,275 | 10/1961 | Reid | 43/18 GF |
| 3,474,858 | 10/1969 | Gibson et al. | 166/359 X |
| 3,512,811 | 5/1970 | Bardgette et al. | 405/227 X |
| 3,559,410 | 2/1971 | Blenkarn et al. | 405/203 |
| 3,605,413 | 9/1971 | Morgan | 405/211 |
| 3,794,849 | 2/1974 | Perry et al. | 405/195 X |
| 3,976,021 | 8/1976 | Blenkarn et al. | 405/208 |

FOREIGN PATENT DOCUMENTS

| | | | |
|---|---|---|---|
| 1349906 | 4/1974 | United Kingdom | 43/18 GF |

*Primary Examiner*—Dennis L. Taylor
*Attorney, Agent, or Firm*—A. Joe Reinert

[57] ABSTRACT

A fixed bottom transition joint for suspended pipe risers includes a structural member. This structural member is defined by a top surface having a predetermined diameter and by a parallel bottom surface having a diameter which is larger than the diameter of the top surface. Further defining the structural member is an outer surface which extends between the top and bottom surfaces and optimally tapers from the bottom surface to the top surface. Finally, an inner surface defines a longitudinal bore through the structural member.

19 Claims, 5 Drawing Figures

VARIABLE STIFFNESS LOWER JOINT FOR PIPE RISER WITH FIXED BOTTOM

BACKGROUND OF THE INVENTION

1. Field of the Invention

This invention relates generally to transition joints and more particularly, but not by way of limitation, to fixed-bottom lower transition joints for suspended pipe risers.

2. Description of the Prior Art (Prior Art Statement)

The following statement is intended to be a Prior Art Statement in compliance with the guidance and requirements of 37 C.F.R. §§1.56, 1.97 and 1.98.

U.S. Pat. No. 3,976,021, issued to Blenkarn et al., shows at FIG. 10, a riser having a transition joint with a straight taper between the upper and lower surfaces of the joint. That transition joint is not fixed at either its upper or lower surface. Blenkarn et al. does not disclose a curvilinear taper or an optimal design for such a taper.

U.S. Pat. No. 3,605,413, issued to Morgan, discloses a riser having a rigidity varying lower portion which interconnects with an upper portion. The lower or base portion is disclosed to be made of steel and to have a non-uniform rigidity or section modulus wherein the maximum is at the foot of the base portion which connects to the seafloor structure, and wherein the minimum is at the top of the base portion which attaches to the upper portion.

To meet such criteria, the Morgan patent indicates that the base structure comprises a plurality of segments with each segment having a different outer diameter and wall thickness relative to every other segment. Although each segment has a different outer diameter, each has the same inner diameter. Each of these sections is interconnected so that the lowermost section has the largest diameter and each successively higher portion has a successively smaller outer diameter. Also, at the point of interconnection of each section there is a taper which compensates for the different outer diameters of the connected segments. It is disclosed in the patent that such tapering could extend along an entire segment.

In addition to the varying diameter segments, the base portion comprises rigidity transition structures which prevent abrupt changes in the radius of curvature and act as stress transfer members between the upper portion of the riser and the upper sections of the base portion of the riser.

Although the Morgan patent does indicate a transition joint comprising elements having different outer diameters, it fails to indicate a joint which has an outer surface which is continuously tapered from the top to the foot of the joint. Furthermore, the Morgan patent fails to disclose an optimally designed transition joint which has a nearly constant resultant stress along the length of its structure.

Other references which Applicant has knowledge of and which may be of relevance include U.S. Pat. No. 3,794,849 issued to Perry et al. which discloses a neutral buoyancy conductor connecting a floating power plant to stationary conductors which then connect the power plant to the shore. The neutral buoyancy conductor is indicated to have constant inner and outer diameters and to bend as a catenary to distribute stress resulting from various loads. The Perry et al. patent also discloses in its drawings vertical structures having continuously varying thicknesses from top to bottom. The specification indicates that these are poured concrete seawalls erected to form channels, but does not further define them.

As with the Morgan patent, the Perry et al. patent fails to show a transition joint which has a continuously varying outer diameter from top to bottom which is optimally shaped to have nearly constant resultant stress along the length of the joint.

Another patent of interest is U.S. Pat. No. 3,559,410 issued to Blenkarn et al. which discloses ring-type stress relief members. However, this patent fails to disclose a longitudinally extending, continuously curvilinearly varying outer diameter transition joint which has nearly constant resultant stress along the length of the structure.

Still another patent known to Applicant is U.S. Pat. No. 3,512,811 issued to Bardgette et al. which discloses a jacket-to-pile connector which has a partially varying thickness wall attached between a jacket leg and a pile to transfer horizontal loads therebetween. This patent, however, fails to indicate a longitudinally extending transition joint having a constant inner diameter, but a curvilinearly varying outer diameter and further having a nearly constant resultant stress along the length of the structure.

Finally, U.S. Pat. No. 1,706,246 issued to Miller discloses in its drawings vertical structures having a continuously varying or tapered outer surface. These vertical structures are walls which have linearly varying thicknesses from top to bottom. However, this patent fails to disclose optimum design criteria or any advantages for having the walls so tapered. Furthermore, this patent fails to disclose a transition joint having such a tapered contour.

As shown by the above-mentioned disclosures, there is a need for a transition joint which, in particular, joins a seafloor structure to a surface structure. There is also the need for such a joint to exhibit a size and strength which can resist the varying loads applied to it and yet to have an optimum design for economy of material and for ease of manufacture.

As indicated above, however, the prior references known and cited by applicant fail to meet the needs because they fail to disclose an optimally designed transition joint which can be particularly used in oil and gas production systems to connect a seafloor structure to a surface structure. In light of the failure of the prior references applicant believes that no previously disclosed device which is known to him indicates, either singly or in combination, the present invention.

SUMMARY OF THE INVENTION

The present invention overcomes the above-noted and other shortcomings of the prior art by providing a novel and improved transition joint. This joint is optimally constructed to withstand the loads applied to it in its ordinary use environment, and yet is economically and easily manufacturable because of its tapered contour whereby a nearly constant resultant stress comprising the outer fiber bending stress and tensile stress results along the entire length of the joint.

The transition joint of the present invention includes a structural member. The preferred embodiment of the structural member is defined by a top planar surface having a predetermined diameter and a bottom planar surface which is parallel to and spaced from the top planar surface and which further has a diameter which is greater than the diameter of the top surface. Further defining the structural member is an outer surface which extends between and joins to the outer contours of the top and bottom planar surfaces. The outer surface has a contour with a continuous curvilinear taper from the larger diameter bottom surface to the smaller diameter top surface. Still further defining the structural member is an inner surface which extends longitudinally through the structural member to define a bore therethrough.

The top surface predetermined diameter is predetermined according to both the outer diameter of the structure to which the top of the transition joint will be connected and the materials of which the joint and connecting structures are made. The degree of taper at any point along the outer surface between the top and bottom surfaces is defined by a diameter across the structural member at that point, which diameter is defined by the following equation:

$$D_x = \sqrt[3]{-\frac{b}{2} + y} + \sqrt[3]{-\frac{b}{2} - y}$$

By defining the outer surface according to the above formula, the transition joint has a substantially constant maximum resultant stress along the entire length of the joint. This provides an optimum transition joint in terms of economy of materials and ease of manufacture while retaining the desired strength against the stresses placed upon the transition joint which result from the bending moments created by loads imparted to the structure from ocean currents, waves and platform motions.

Therefore, from the foregoing, it is a general object of the present invention to provide a novel and improved transition joint.

Other and further objects, features and advantages of the present invention will be readily apparent to those skilled in the art upon a reading of the description of the preferred embodiment which follows, when taken in conjunction with the accompanying drawings.

DETAILED DESCRIPTION OF A PREFERRED EMBODIMENT OF THE INVENTION

Figure 1:
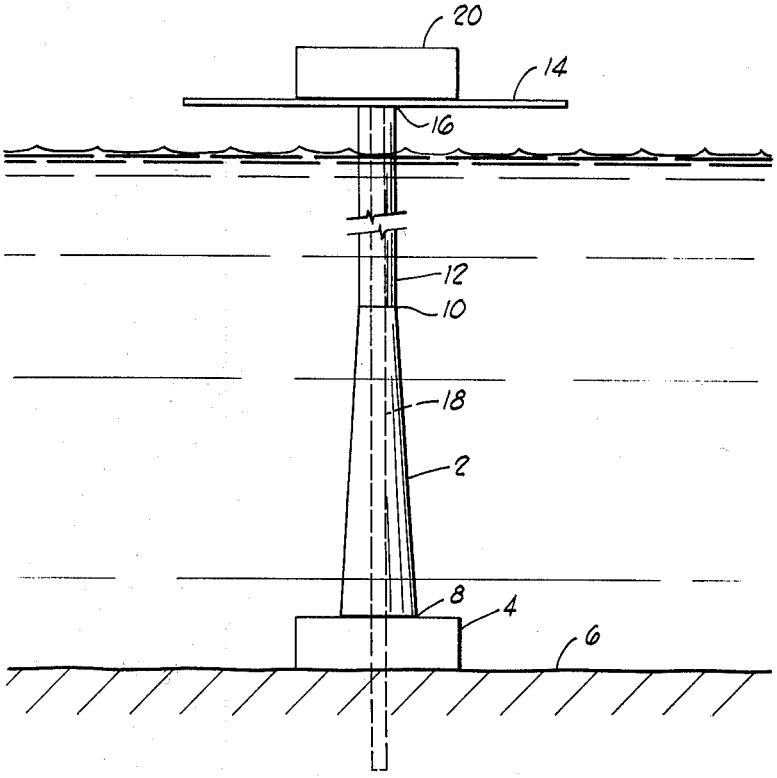
FIG. 1 is a schematic illustration of the present invention in its preferred use environment.

Referring now to the drawings and particularly to FIG. 1, Applicant diagrammatically shows a transition joint 2 according to the present invention positioned in its preferred use environment as a lower transition joint for a pipe riser with a fixed bottom. The preferred embodiment of the transition joint 2 comprises high strength steel and has a length of approximately fifty feet. This length is considered to be preferred because it provides ease of fabrication and yet is long enough to retain the advantages of a theoretically optimum transition joint which would extend the entire distance between the ultimate points to be joined.

The transition joint 2 connects to a portion of a seafloor anchor base structure 4 which is positioned on a seafloor 6. The structure 4 includes, in part, a wellhead body and wellhead connector. The wellhead connector, to which the transition joint 2 connects at a base portion 8, may be either a hydraulically actuated connector or a threaded connector. It is at the base portion 8 that the bending moments resulting from loads on the transition joint 2 are the greatest, and thus this portion must be sufficiently large to withstand such stresses. The size and strength of the wellhead connector and the other components comprising the structure 4 are sufficiently larger than the base 8 of transition joint 2, so that base 8 may be considered to be fixed.

At the end of the transition joint 2 opposite the base portion 8 is a top portion 10. At the top portion 10 the loads are not as large as those at the base 8, so the top portion 10 need not be as large as the base portion 8. Also at the top portion 10 the transition joint 2 connects with a pipe string 12 which in the FIG. 1 schematic representation is preferably a $9\frac{5}{8}''$ tie-back string or riser. Pipe string 12 and transition joint 2 comprise a riser pipe assembly.

The string 12 extends from the transition joint 2 upward to a surface platform 14. Platform 14 is a floating tension leg type platform. The string 12 connects with the platform 14 at a connection 16 which, in a preferred embodiment, is a tensioning jack.

Located within the previously described subsurface structures is a transport string 18 which provides a means of access between the platform 14 and the region below the seafloor 6. In the presently described preferred embodiment the transport string 18 is a production riser which communicates the substances to be obtained from the subseafloor regions to the platform 14.

Completing the FIG. 1 schematic is a member 20 which is disposed on the platform 14 and which is associated with the transport string 18 for controlling the dispersement of materials to and from the transport string 18 at the surface platform 14. The member 20 is preferably a completion tree.

Figure 2:
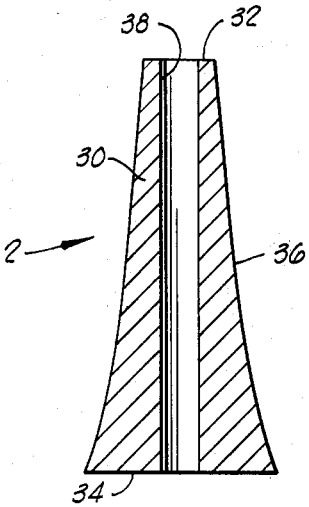
FIG. 2 is an elevation view of the present invention taken in section.
Figure 3:
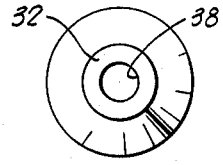
FIG. 3 is a top plan view of the present invention.
Figure 4:
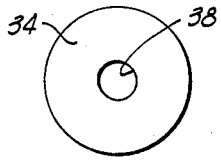
FIG. 4 is a bottom plan view of the present invention.

Referring now to FIGS. 2, 3 and 4, a preferred embodiment of the transition joint 2 is shown. The transition joint 2 includes a structural member 30 which is defined by a first top planar surface 32, a second bottom planar surface 34, a third outer surface 36 and a fourth inner surface 38. Transition joint 2 is solid in the space defined between first, second, third and fourth surfaces 32, 34, 36 and 38.

The top planar surface 32 is annular and has an outer contour which is defined by a predetermined diameter. This predetermined diameter is selected according to the diameter and composition of the string 12 with which the transition joint connects. Parallel to the top surface 32 is the bottom planar surface 34 which is also annular and has an outer contour which is defined by a diameter which is larger than the diameter defining the outer contour of the top surface 32. Top and bottom surfaces 32 and 34 are in spaced relation.

Longitudinally defining the structural member 30 are the outer surface 36 and the inner surface 38. The outer surface 36 extends between, joins to and circumscribes the outer contours of the top surface 32 and the bottom surface 34. The contour of the surface 36 has a curvilinear taper from the bottom surface 34 to the top surface 32. The inner surface 38 likewise extends between the top surface 32 and the bottom surface 34, but extends perpendicular thereto to thereby define a longitudinal bore through the structural member 30.

Figure 5:
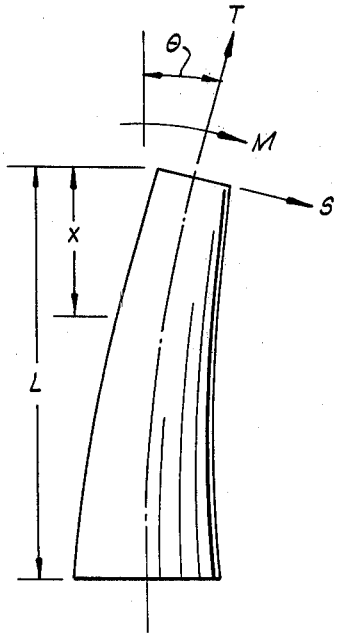
FIG. 5 is a schematic illustration of the present invention under a load.

Referring now to FIG. 5, the tapered contour of the outer surface 36 will be described. Initially, it is noted that the taper is continuous along the entire length of the joint which thus makes the length of the tapered contour relatively greater than the longest cross-sectional diameter of the joint. FIG. 5 schematically represents the transition joint 2 under a load resulting from, for example, the ocean currents, waves or platform motions. These loads impart bending moments and other stresses to the joint 2 such as indicated in FIG. 5 by an axial tension load T, a shear load S and a moment M. A result of these stresses is a resultant stress which results both from the bending stress on the outer fibers along the length of the convex outer surface of the joint and from the tensile stress on the joint. In order to obtain an optimum transition joint the contour of the outer surface 36 is to be shaped in accordance with the present invention so that this resultant stress is nearly constant along the entire length of the joint. This is accomplished by tapering the outer surface 36 according to the following equation:

$$D_x = \sqrt[3]{-\frac{b}{2} + y} + \sqrt[3]{-\frac{b}{2} - y} \tag{1}$$

Applicant discovered this equation and its underlying parametric definitions by combining certain assumptions with certain analyses. The assumptions included the joint 2 being fixed at its base 8 as depicted in FIG. 1 and having a constant internal diameter as depicted by the bore defined by the inner surface 38. Furthermore, it was assumed that the joint 2 was of the same material as the string 12 and that the forces T, M and S were known.

Having made these assumptions, Applicant defined certain parameters as follows, then made the accompanying analysis:

T=tension, top of joint, lbs.
M=moment, top of joint, ft-lbs.
S=shear, top of joint, lbs.
$\theta$=angle from vertical, top of joint, degrees
L=length of joint, ft.
d=inside diameter, ft.
x=distance along riser, measured from top downward, ft.
$\sigma$=outer fiber total axial stress, lbs/ft$^2$
$A_x$=cross-sectional area at x, ft.$^2$
$D_x$=outside diameter at x, ft.
$I_x$=moment of inertia at x, ft.$^4$
$T_x, M_x, S_x, \theta_x$=same as above, measured at point x From beam small deflection theory:

$$\sigma = \frac{M_x D_x}{2I_x} + \frac{T_x}{A_x} \tag{2}$$

Assuming $T_x$=T, the total moment at x ($M_x$) in terms of the top conditions is $$M_x = M + Sx + Tx \sin \theta_x. \tag{3}$$

By assuming that $\theta_x$ varies linearly with x, then $$\theta_x = \frac{x}{L}\theta. \tag{4}$$

and from (3) and (4)

$$M_x = M + Sx + Tx\sin\left(\frac{x}{L}\theta\right). \tag{5}$$

By letting $$F = S + T\sin\left(\frac{x}{L}\theta\right), \tag{6}$$

then:

$$M_x = M + Fx. \tag{7}$$

Now solving (2) for $M_x$ and assuming $T_x$=T $$M_x = \left(\sigma - \frac{T}{A_x}\right)\frac{2I_x}{D_x}. \tag{8}$$

Next, Equating (7) and (8) yields $$M + Fx = \left(\sigma - \frac{T}{A_x}\right)\frac{2I_x}{D_x}. \tag{9}$$

By definition and standard formulae:

$$I_x = \frac{\pi}{64}(D_x^4 - d^4) \tag{10}$$

$$A_x = \frac{\pi}{4}(D_x^2 - d^2) \tag{11}$$

Upon substituting these definitions from (10) and (11) into (9) and simplifying:

$$M + Fx = \frac{\pi}{32}\sigma\frac{D_x^4 - d^4}{D_x} - \frac{T}{8}\frac{D_x^2 + d^2}{D_x} \tag{12}$$

By assuming that $$\frac{D_x^4 - d^4}{D_x} \simeq D_x^3 - d^3 \tag{13}$$

and $$\frac{D_x^2 + d^2}{D_x} \simeq D_x + d. \tag{14}$$

then:

$$M + Fx = \frac{\pi}{32}\sigma(D_x^3 - d^3) - \frac{T}{8}(D_x + d). \tag{15}$$

Regrouping equation (15) in terms of $D_x$ yields $$\frac{\pi}{32}\sigma D_x^3 - \frac{T}{8}D_x + \left(-\frac{\pi}{32}\sigma d^3 - \frac{T}{8}d - M - Fx\right) = 0, \tag{16}$$

and letting $$G = \frac{\pi}{32}\sigma,\ H = \frac{T}{8},\ J = -\frac{\pi}{32}\sigma d^3 - \frac{T}{8}d - M - Fx \tag{17}$$

and substituting into (16) gives $$GD_x^3 - HD_x + J = 0. \quad (18)$$

Putting (18) into the standard cubic equation form of $x^3+ax+b=0$ results in $$D_x^3 - \frac{H}{G} D_x + \frac{J}{G} = 0. \quad (19)$$

Thus for solution of the standard cubic equation in this situation, $$a = -\frac{H}{G},\ b = \frac{J}{G},\ \text{and}\ y = \sqrt[3]{\frac{b^2}{4} + \frac{a^3}{27}}. \quad (20)$$

In terms of these definitions in (20), the solution of (19) is $$D_x = \sqrt[3]{-\frac{b}{2} + y} + \sqrt[3]{-\frac{b}{2} - y}. \quad (21)$$

This solution when expanded to incorporate the underlying parametric definitions of b and y expresses the outer diameter at a point x along the length of the joint 2 in terms of distance x, known conditions of the forces at the top of the joint, and desired maximum stress $\sigma$.

In expanded form, the expression for b is:

$$b = \left[-\frac{\pi}{32}\sigma d^3 - \frac{T}{8} d - M - Sx - Tx \sin\left(\frac{x}{L}\theta\right)\right] / \frac{\pi}{32}\sigma$$

In the preferred embodiment of the present invention it was assumed that the joint 2 was made of the same material as the string 12. Under this assumption the value of the outer fiber total axial stress, $\sigma$, should be such that $D_x$ at $x=0$ (i.e., at the top of the joint 2) equals the outer diameter of the string (or riser) 12. Thus, for $D_{x=0}=D_{(riser)}$, solving equation (15) for $\sigma$ and letting $D_x=D_{(riser)}$ yields $$\sigma = \frac{32}{\pi(D_{(riser)}^3 - d^3)}\left[M + \frac{T(d_{(riser)} + d)}{8}\right]. \quad (22)$$

By manufacturing the transition joint 2 having outer surface 36 tapered according to equation (21), the optimum transition joint of the present invention will be obtained. Such an optimum joint has the requisite strength at its large base for withstanding applied loads, yet is optimally tapered to maintain a nearly constant resultant stress along the entire length of the joint thereby retaining the required strength throughout the structure but providing optimum economy of material and ease of manufacture. Therefore, the present invention has overcome the failures of the previously cited references to provide an optimally designed and manufactured transition joint.

Thus, the present invention of a transition joint having longitudinally tapered sides is well adapted to carry out the objects and attain the ends and advantages mentioned above as well as those inherent therein. While a preferred embodiment of the invention has been described for the purpose of this disclosure, numerous changes in the construction and arrangement of parts can be made by those skilled in the art, which changes are encompassed within the spirit of this invention as defined by the appended claims.

What is claimed is:

1. A structural member, comprising:

a first surface;

a second surface in spaced relation to said first surface;

a third surface extending between, joining to, and circumscribing said first and second surfaces, said third surface having a continuous curvilinear taper from said second surface to said first surface, said continuously curvilinearly tapered third surface being further characterized as a means for providing a substantially constant resultant stress in said structural member between said first and second surfaces for a given axial load, shear load and bending moment at said first surface, said resultant stress being defined as a sum of an outer fiber bending stress and an axial stress; and a fourth surface disposed concentrically within said third surface and extending between and joining to said first and second surfaces, said fourth surface being a constant diameter cylindrical inner surface.

2. A structural member as recited in claim 1, wherein said second surface is constructed to be fixedly attached to a base structure.

3. A structural member as recited in claim 1, wherein said first and second surfaces are annular surfaces.

4. A structural member as recited in claim 1, wherein said fourth surface extends perpendicularly to both of said first and second surfaces.

5. A structural member, comprising:

a first surface;

a second surface in spaced relation to said first surface;

a third surface extending between, joining to, and circumscribing said first and second surfaces, said third surface having a continuous curvilinear taper from said second surface to said first surface, said taper being such that, for a given axial load, shear load and bending moment at said first surface, a resultant stress of said structural member is substantially constant between said first and second surfaces, said resultant stress being defined as a sum of an outer fiber bending stress and an axial stress; and a fourth surface disposed concentrically within said third surface and extending between and joining to said first and second surfaces, said fourth surface extending perpendicularly to both of said first and second surfaces;

wherein a contour of said third surface is defined by a plurality of cross-sectional diameters of said structural member, which diameters are determined by $$D_x = \sqrt[3]{-\frac{b}{2} + y} + \sqrt[3]{-\frac{b}{2} - y},$$

where $D_x$=cross-sectional diameter at a distance x from said first surface, $$b = \left[ -\frac{\pi}{32}\sigma d^3 - \frac{T}{8}d - M - Sx - Tx\sin\left(\frac{x}{L}\theta\right)\right] / \frac{\pi}{32}\sigma$$

where $\sigma$=outer fiber total axial stress along said third surface, in pounds per square foot d=inside diameter of said fourth surface, in feet T=tension at said first surface, in pounds M=moment at said first surface, in foot-pounds x=distance along said third surface measured from said first surface toward said second surface, in feet S=shear at said first surface, in pounds L=length of said structural member, in feet $\theta$=angle from vertical said structural member is at said first surface, in degrees and $$y = \sqrt[3]{\frac{b^2}{4} + \frac{a^3}{27}}$$

where $a = -(4T/\pi\sigma)$.

6. A structural member as recited in claim 5, wherein said structural member is solid between said first, second, third and fourth surfaces.

7. A transition joint for connecting a seafloor structure with a seasurface structure in an oil and gas production system, comprising:

a structural member including:

a top surface;

a bottom surface in spaced relation and parallel to said top surface;

an outer surface joining said top and bottom surfaces, said outer surface having a curvilinear taper from said bottom surface to said top surface, said taper being such that, for a given axial load, shear load and bending moment at said top surface, a maximum resultant stress of said structural member is substantially constant along a length of said structural member between said top and bottom surfaces; and an inner surface lying within said outer surface and extending perpendicularly between said top and bottom surfaces thereby defining a bore through said structural member.

8. A riser pipe assembly, connected between a seafloor anchor base structure and a platform, said assembly including the transition joint of claim 7, and being further characterized in that:

said assembly includes a pipe string having an upper end connected to said platform and a lower end connected to said top surface; and said bottom surface is fixedly attached to said seafloor anchor base structure.

9. A riser pipe assembly as recited in claim 8, wherein said top and bottom surfaces are annular surfaces.

10. A riser pipe assembly as recited in claim 9, wherein an outer diameter of said top surface is equal to an outer diameter of said pipe string.

11. A riser pipe assembly as recited in claim 10, wherein said transition joint and said pipe string are constructed from the same material.

12. A transition joint as recited in claim 7, wherein said outer surface contour is defined by a plurality of cross-sectional diameters of said structural member, said diameters extending perpendicularly to the longitudinal axis of said inner surface and said diameters defined by $$D_x = \sqrt[3]{-\frac{b}{2} + y} + \sqrt[3]{-\frac{b}{2} - y},$$

where $D_x$=cross-sectional diameter at a distance x from said first surface, $$b = \left[ -\frac{\pi}{32}\sigma d^3 - \frac{T}{8}d - M - Sx - Tx\sin\left(\frac{x}{L}\theta\right)\right] / \frac{\pi}{32}\sigma$$

where $\sigma$=outer fiber total axial stress along said outer surface, in pounds per square foot d=inside diameter of said inner surface, in feet T=tension at said top surface, in pounds M=moment at said top surface, in foot-pounds x=distance along said outside surface measured from said top surface toward said bottom surface, in feet S=shear at said top surface, in pounds L=length of said structural member, in feet $\theta$=angle from vertical said structural member is at said top surface, in degrees and $$y = \sqrt[3]{\frac{b^2}{4} + \frac{a^3}{27}}$$

where $a = -(4T/\pi\sigma)$.

13. A riser pipe assembly, connected between a seafloor anchor base structure and a platform, said assembly including the transition joint of claim 12, and being further characterized in that:

said assembly includes a pipe string having an upper end connected to said platform and a lower end connected to said top surface; and said bottom surface is fixedly attached to said seafloor anchor base structure.

14. A riser pipe assembly as recited in claim 13, wherein said top and bottom surfaces are annular surfaces.

15. A riser pipe assembly as recited in claim 14, wherein an outer diameter of said top surface is equal to an outer diameter of said pipe string.

16. A riser pipe assembly as recited in claim 15, wherein said transition joint and said pipe string are constructed from the same material.

17. A structural member, comprising:

a first end;

a second end, spaced from said first end;

an outer surface extending between said first and second ends, said outer surface having a continuous curvilinear taper from said second end to said first end, said continuously curvilinearly tapered outer surface being further characterized as a means for providing a substantially constant resultant stress in said structural member between said first and second ends for a given axial load, shear load and bending moment at said first end, said resultant stress being defined as a sum of an outer fiber bending stress and an axial stress; and a constant diameter cylindrical inner surface disposed concentrically within said outer surface and extending between said first and second ends.

18. A structural member as recited in claim 17, wherein a contour of said outer surface is defined by a plurality of cross-sectional diameters of said structural member, which diameters are determined by $$D_x = \sqrt[3]{-\frac{b}{2} + y} + \sqrt[3]{-\frac{b}{2} - y}$$

where $D_x$=cross-sectional diameter at a distance x from said first end, $$b = \left[-\frac{\pi}{32}\sigma d^3 - \frac{T}{8}d - M - Sx - Tx\sin\left(\frac{x}{L}\theta\right)\right] /$$

-continued $$\frac{\pi}{32}\sigma$$

where $\sigma$=outer fiber total axial stress along said outer surface, in pounds per square foot d=inside diameter of said inner surface, in feet T=tension at said first end, in pounds M=moment at said first end, in foot-pounds x=distance along said outer surface measured from said first end toward said second end, in feet X=shear at said first end, in pounds L=length of said structural member, in feet $\theta$=angle from vertical said structural member is at said first end, in degrees and $$y = \sqrt[3]{\frac{b^2}{4} + \frac{a^3}{27}}$$

where $a = -4T/\pi\sigma$.

19. The structural member of claim 18, further characterized as being a transition joint connecting a seafloor structure with a seasurface structure in an oil and gas production system.

* * * * *